US006591789B1

(12) United States Patent
Lee

(10) Patent No.: US 6,591,789 B1
(45) Date of Patent: Jul. 15, 2003

(54) DEVICE TO GENERATE HEAT BY SPRAYING LIQUID AT HIGH SPEED AND HIGH PRESSURE

(76) Inventor: Woo-dong Lee, 101-102, Euntap Apt. #70, Siji-dong, Susung-gu, Daegu 706-220 (KR)

( * ) Notice: Subject to any disclaimer, the term of this patent is extended or adjusted under 35 U.S.C. 154(b) by 0 days.

(21) Appl. No.: 10/130,574

(22) PCT Filed: Nov. 2, 2000

(86) PCT No.: PCT/KR00/01245

§ 371 (c)(1),
(2), (4) Date: Jul. 30, 2002

(87) PCT Pub. No.: WO01/38800

PCT Pub. Date: May 31, 2001

(30) Foreign Application Priority Data

Nov. 20, 1999 (KR) ..... 1999-51762

(51) Int. Cl.[7] ..... F22B 1/02
(52) U.S. Cl. ..... 122/235.29; 122/28; 122/406.1
(58) Field of Search ..... 122/367.1, 367.3, 122/26, 28, 235.29, 49, 406.1, 406.2, 406.3, 235.23; 165/109.1; 237/12.3 R, 12.3 B, 59

(56) References Cited

U.S. PATENT DOCUMENTS 3,081,749 A * 3/1963 Stabenow ..... 122/406.3
4,457,083 A 7/1984 Kuboyama
4,489,678 A 12/1984 Hamilton et al.
4,651,681 A * 3/1987 Perkins ..... 122/26
4,921,041 A * 5/1990 Akachi ..... 165/104.29
6,237,545 B1 * 5/2001 Barnett et al. ..... 122/235.23

FOREIGN PATENT DOCUMENTS

JP 50-42653 4/1975
JP 62-242766 10/1987

* cited by examiner

*Primary Examiner*—Gregory Wilson
(74) *Attorney, Agent, or Firm*—Dilworth & Barrese, LLP

(57) ABSTRACT

A high-speed and high-pressure injection heat-generating device is provided, and enables liquid injected at a high speed and under a high pressure to become heated by the force of the friction and resistance generated from the collisions of liquid molecules as passing through a heating generating unit, and thus the heated liquid can be used for the purpose of heating water. By connecting a liquid circulating pump to a liquid feeding tube through which source liquid is supplied to the heating generating device on the outlet side of the liquid circulating pump and providing a tube with bends in the heating unit, where the tube includes a plurality projections closely formed on an inner surface thereof, more heating efficiency can be obtained. Therefore, the heat generating device can provide a heating source or hot water thereby obtaining a high temperature efficiency in variety of fields such as heating and hot water supply, without consuming energy sources like oil or gas.

9 Claims, 3 Drawing Sheets

DEVICE TO GENERATE HEAT BY SPRAYING LIQUID AT HIGH SPEED AND HIGH PRESSURE

BACKGROUND OF THE INVENTION

1. Field of the Invention

The present invention relates to a heat generating device, and more particularly, to a device for generating heat by spraying liquid at high speed and high pressure that heat the liquid when it passes through a heat generating unit where its molecules are forced to collide one another, resulting in generating friction and resistance, thereby employing the heated liquid as a heat source for heating or hot water supplying.

2. Description of the Related Art

Conventionally, several known heat sources such as electricity, oil, gas, etc. are utilized for heating and the heat from the sources is used to supply hot water. Among the heat sources, oil or gas needs to be burned to function as heat sources, which causes environmental pollution in all its aspects like air, water, etc. To use only electricity as a heat source inevitably leads to the excessive consumption of electricity, especially in a certain season where the supply falls short of the demand. Besides, the source of the electricity is generated by burning natural energy like oil or gas. Thus, it is at present unavoidable to encounter the above-mentioned serious problems including environmental pollution.

SUMMARY OF THE INVENTION

It is an object of this invention to provide a device for generating heat by spraying liquid at high speed and high pressure that sprays the liquid into a heat generating unit where the molecules of the liquid collide against the walls thereof or the projections provided therein, thereby creating friction and resistance which cause the liquid to be heated, whereby the heated liquid can be utilized as a heat source including for heating or supplying hot water.

It is another object of this invention to provide a device for generating heat by spraying liquid at high speed and high pressure that is provided with a liquid circulating pump that is coupled on a liquid feeding pipe on the inlet thereof, a heat generating unit that is coupled with the outlet thereof, and a plurality of projections that are closely formed on the inner peripheral wall of the heat generating unit, whereby while the liquid is passed through the heat generating unit, the molecules of the liquid collide against the plurality of projections on the inner wall of the heat generating unit, resulting in the generation of friction and resistance therefrom that cause the liquid to be heated to high temperature.

DETAILED DESCRIPTION OF THE PREFERRED EMBODIMENTS

Figure 1:
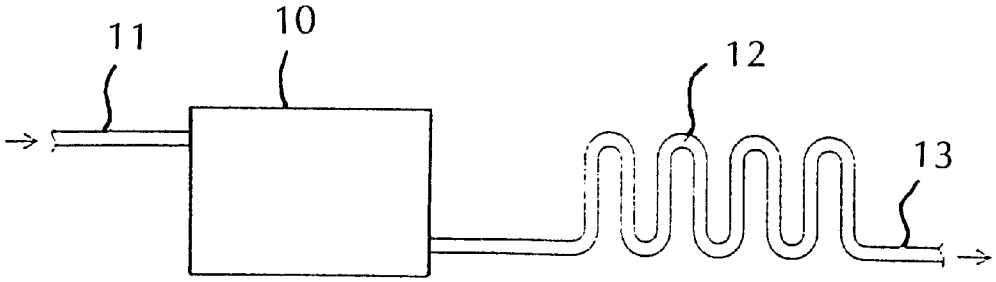
FIG. 1 is a diagrammatic side view of a basic configuration of a heat generating device according to the present invention.

A preferred embodiment of the present invention will be described hereinbelow with reference to the accompanying drawings. In the following description, like reference numerals identify similar or identical elements throughout the several views, while well-known functions or constructions are not described in detail so as not to obscure the invention in unnecessary detail.

Figure 2A:
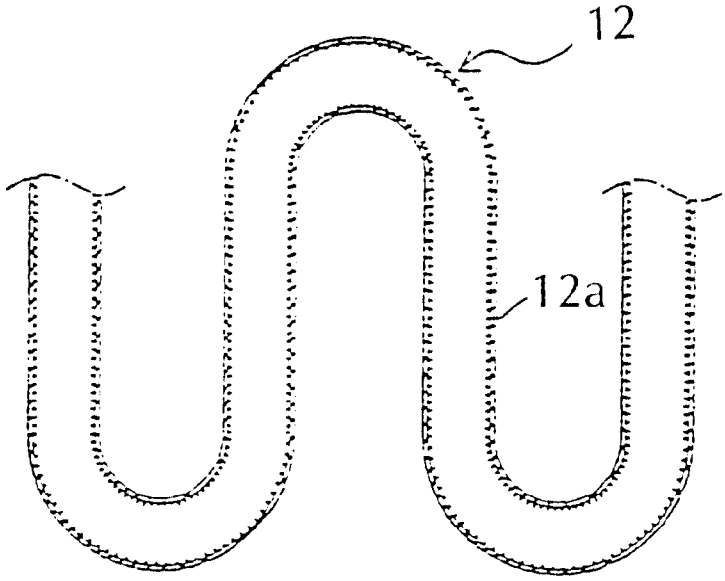
FIGS. 2A and 2B are side sectional views of several types of generating units in the heat generating device according to the present invention.
Figure 2B:
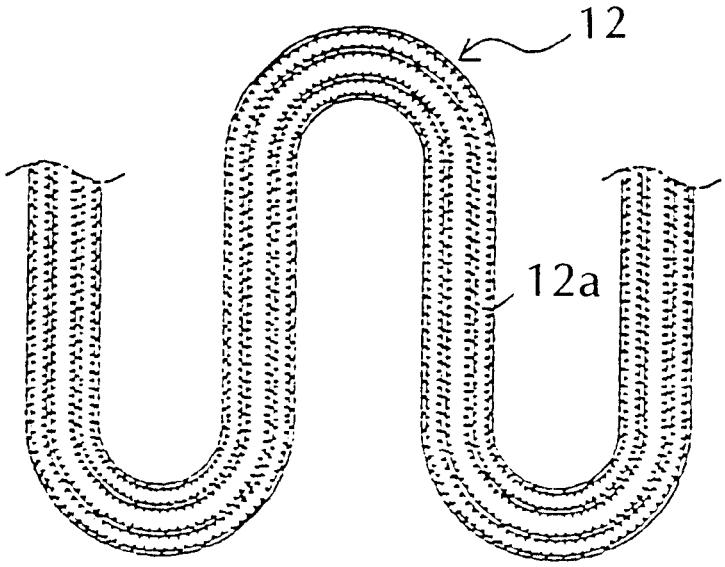

Referring to FIGS. 1 and 2(A) and (B), the construction of this invention contains the liquid circulating pump 10 that is coupled with the liquid feeding tube 11 via the inlet of the liquid circulating pump 10 and the heat generating unit 12 with the outlet of the liquid circulating pump 10. In this case, the heat generating unit 12 comprises two or more bends in a continuous, repetitive way and the plurality of projections 12*a* that are closely formed therein. It is contemplated that any number of units 12 may be connected together with or without additional pumps 10. The heat generating unit 12 is a means to induce the liquid molecules to collide with one another for generating heat. The collision of the liquid molecules may be promoted by increasing the flowing speed of the liquid when the plurality of projections 12*a* are created in every or every other heat generating unit 12. Otherwise, another tube having a smaller diameter than the heat generating unit 12 may be mounted within the heat generating unit 12, having the plurality of projections 12*a* on the inner and outer circumferences thereof, respectively, such that the collision of the liquid molecules may be further accelerated. Ultimately, this invention relates to the efficiency to raise temperature depending on the amount of collisions among the liquid molecules. Any type of heat generating unit 12 may be employed as long as the projections 12*a* are formed therein. In other words, the formation of the projections 12*a* within the heat generating unit 12, irrespective of the type of the heat generating unit 12, may be involved in the scope of this invention. Furthermore, considering that the tube diameter and length of the heat generating unit 12 are a function of the capacity of the liquid circulating pump 10, they cannot be specified and therefore, after the liquid circulating pump 10 is first selected according to its purpose of use, they may be calculated and defined according to the capacity of the pump.

Figure 3:
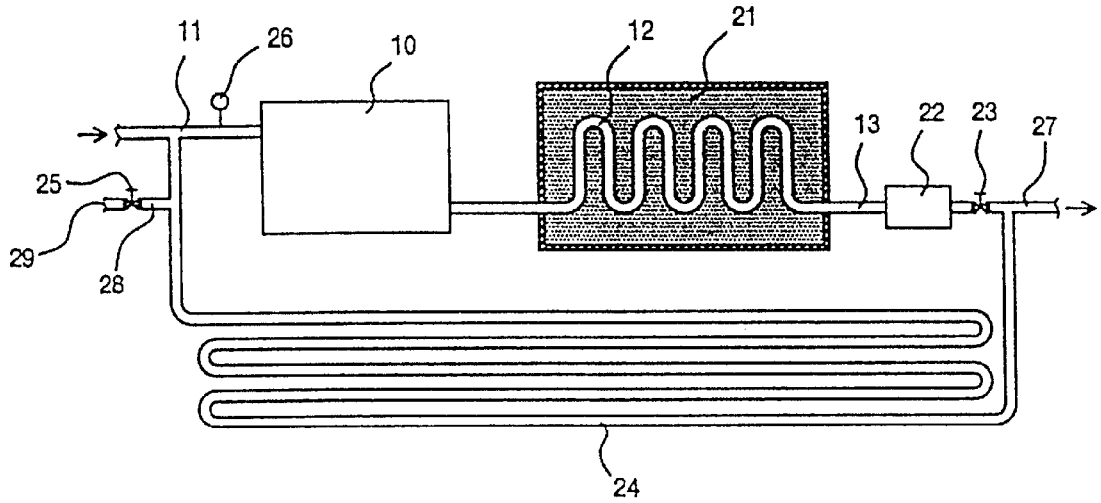
FIG. 3 is a diagrammatic side sectional view of a preferred embodiment according to the present invention.

Referring to FIG. 3, the liquid circulating pump 10 is connected to the liquid feeding tube 11 supplying source liquid through the inlet thereof, and the heat generating unit 12 having a heat cover 21 thereon is connected with the outlet of pump 10. Unit 12 is [thereof] coupled to a secondary circulating pump 22 and a circulating valve 23. An air discharge outlet 27 is disposed in the rear outlet of the circulating valve 23 and a liquid passway tube 24 is disposed just in front of the air discharge outlet 27. The liquid passway tube 24 is connected to the liquid feeding tube 11, while liquid may be discharged through a discharge tube 28 with a liquid discharge outlet 29 by a liquid discharge valve 25 at a predetermined position. Under the above construction, if the source liquid is fed through the liquid feeding tube 11, the liquid has high speed and high pressure when it passes through the liquid circulating pump 10 and fed to the heat generating unit 12. The liquid collides against the walls and projections 12*a* within the heat generating unit 12. In the meantime, the liquid molecules collide with one another to thereby create friction and resistance, resulting in an increase of the liquid temperature. Consequently, heat higher than the normal temperature is generated and kept constant with the heat cover 21 not radiating heat. The hot liquid at a higher than normal temperature may be discharged as hot air or hot liquid according to the direction of the circulating valve 23 via the circulating pump 22. At the time, the hot air discharged from the heat generating unit 12 by the circulating pump 22 is collected on the upper portion of the circulating pump 22 and the hot liquid discharged thereby is collected on the lower portion thereof. At this time, if the hot air is designed to be discharged to the air discharge outlet 27 at the time when the temperature thereof is sensed by a thermal sensor 26, this kind of construction will as a heater. On the other hand, the hot liquid may pass through the liquid passway tube 24 to forcedly return to the liquid feeding tube 11 and then pass through the liquid circulating pump 10 and the heat generating unit 12 again. Consequently, the liquid temperature increases higher than that before the liquid passes through the liquid passway tube 24. In this case, the liquid passway tube 24 can be utilized for the heating for houses and apartment complexes. And, supplying hot water may be available by opening the liquid discharge valve 25 of the liquid discharge tube 28 located on the side of the outlet of the liquid passway tube 24. The temperature generated from the liquid passway tube 24 depends on the capacity and tube diameter of the liquid circulating pump 10 and on the size and length of the heat generating unit 12.

A result of experiment on the present invention shows the changeable range of temperature as follows.

On the following conditions

Air temperature: 22° C.

Liquid circulating pump: 1.5 HP (horsepower)

Length & tube diameter of heat generating unit: L10 m×4 mm

Feeding temperature of source liquid: 16.5° C.

The changeable range of temperature is defined as follows:

TABLE 1

| No. | Time (minutes) | Temperature |
|---|---|---|
| 1 | 5 minutes later | 26.5° C. |
| 2 | 10 minutes later | 33° C. |
| 3 | 15 minutes later | 38° C. |
| 4 | 20 minutes later | 42° C. |
| 5 | 25 minutes later | 46° C. |
| 6 | 30 minutes later | 48.5° C. |
| 7 | 35 minutes later | 50° C. |

As appreciated from Table 1, it can be noted that the temperature increases greatly at first and the range thereof then decreases as time elapses. Anyway, it is concluded that the temperature rises according to the increase of time. When the temperature reaches a certain level, it rises slowly or stays at the same level because the heat loss caused by low air temperature increases. The liquid in the above experiment according to the present invention is embodied by using pure water ($H_2O$), but it may not be limited to water. As a matter of fact, other liquids may provide higher temperature than water and therefore, they can be applied for various fields needing a heat source.

Thus, this invention can be employed for heating by raising the liquid temperature higher than it's normal temperature when the liquid molecules are forced to collide with one another by a heat generating unit and thus be applied for a heater by discharging the resultant air generated when the temperature of the liquid increases and for supplying hot water by discharging the liquid in the course of heating.

While the invention has been particularly shown and described with reference to preferred embodiments thereof, it will be understood by those skilled in the art that various changes in form and details may be made therein without departing from the spirit and scope of the invention.

What is claimed is:

1. A heat generating device using liquid at high speed and high pressure, said device comprising:

a liquid circulating pump connected with a liquid feeding tube supplying source water, for feeding the liquid at the high speed and high pressure; and a heat generating unit connected with an outlet side of said liquid circulating pump and having a tube provided with a plurality of projections that are closely formed on an inner surface thereof such that molecules of the liquid to collide against said plurality of projections and with each other, said tube of the heat generating unit having a series of bends along a predetermined length such that the flowing time of the liquid is kept for a predetermined period of time.

2. The heat generating device according to claim 1, wherein said bends of the tube of the heat generating unit comprise two or more bends in a continuous, repetitive path.

3. The heat generating device according to claim 1, wherein said liquid is selected from one of water, oil and gas.

4. The heat generating device according to claim 1, wherein another tube having smaller diameter than the heat generating unit and having the plurality of projections on the inner and outer circumferences thereof is mounted within the heat generating unit.

5. A heat generating device by spraying liquid at high speed and high pressure, said device comprising:

a liquid circulating pump connected with a liquid feeding tube through which source water is supplied, for spraying the liquid at the high speed and high pressure;

a heat generating unit connected with an outlet portion of said liquid circulating pump and provided with a plurality of projections that are closely formed therein such that the liquid collides each other to thereby cause the molecules of the liquid to collide against said plurality of projections, said heat generating unit extended to be bent up to a predetermined length such that the flowing time of the liquid is kept for a predetermined period of time;

a circulating pump for the hot water form the heating generating unit to effectively be circulated or discharged;

a liquid passway tube through which hot water from the circulating pump is returned to the liquid feeding tube to be supplied into the heating generating unit repeatedly;

an air discharge outlet through which hot air is discharged for being functioned as a heater;

a liquid discharge tube through which the hot water passes for having effect on the heating for houses and apartment complexes.

6. The heat generating device according to claim 5, further comprising at least a liquid discharge valve and a circulating valve.

7. The heat generating device according to claim 5, wherein said heat generating unit is constructed two or more in a continuous, repetitive way.

8. The heat generating device according to claim 5, wherein said liquid is selected from one of water, oil and gas.

9. The heat generating device according to claim 5, wherein another tube having smaller diameter than the heat generating unit and having the plurality of projections on the inner and outer circumferences thereof is mounted within the heat generating unit.

* * * * *